United States Patent [19]

Erni et al.

[11] Patent Number: 4,980,952

[45] Date of Patent: Jan. 1, 1991

[54] TRANSVERSE CONVEYOR ARRANGEMENT AT THE OUTLET OF A CARD

[75] Inventors: Daniel Erni, Frauenfeld; Paul Staeheli, Wilen b. Wil, both of Switzerland

[73] Assignee: Maschinenfabrik Rieter AG, Winterthur, Switzerland

[21] Appl. No.: 417,896

[22] Filed: Oct. 6, 1989

[30] Foreign Application Priority Data

Oct. 6, 1988 [DE] Fed. Rep. of Germany ..... 3834039

[51] Int. Cl.[5] ..... D01G 15/46

[52] U.S. Cl. ..... 19/106 R

[58] Field of Search ..... 19/106 R

[56] References Cited

U.S. PATENT DOCUMENTS

| | | | |
|---|---|---|---|
| 3,345,700 | 10/1967 | Kalwaites | 19/106 R |
| 3,481,004 | 12/1969 | Wright et al. | 19/106 R |
| 4,299,011 | 11/1981 | Rothen et al. | 19/106 R |
| 4,722,118 | 2/1988 | Fahmueller | 19/106 R |
| 4,809,404 | 3/1989 | Lasenga | 19/106 R |

FOREIGN PATENT DOCUMENTS

| | | | |
|---|---|---|---|
| 2061215 | 6/1971 | Fed. Rep. of Germany . | |
| 2109955 | 10/1971 | Fed. Rep. of Germany . | |
| 2148975 | 4/1972 | Fed. Rep. of Germany | 19/106 R |
| 3240978 | 5/1983 | Fed. Rep. of Germany . | |
| 1075823 | 4/1986 | Japan | 19/106 R |
| 432310 | 9/1967 | Switzerland . | |
| 448823 | 4/1968 | Switzerland . | |
| 340716 | 6/1972 | U.S.S.R. | 19/106 R |
| 1155598 | 6/1969 | United Kingdom . | |
| 1337165 | 11/1973 | United Kingdom . | |
| 2056513 | 3/1981 | United Kingdom . | |

*Primary Examiner*—Werner H. Schroeder
*Assistant Examiner*—John J. Calvert
*Attorney, Agent, or Firm*—Burns, Doane, Swecker & Mathis

[57] ABSTRACT

A guide device for compressing a fibre web exiting from a transverse conveyor arrangement at the outlet of a card. The fibre web leaving the card outlet rolls is conveyed to one side of the card, where it is guided downward by the guide device. The rolls are disposed above the transverse conveyor and each has a step-like constriction at an end associated with the guide device and outwardly of a point at which the fibre web is deflected around a deflection roller of the transverse conveyor. The guide device is partially received in the constriction and a nip or a nip zone is formed between the guide device and the adjacent deflection roller of the transverse conveyor. The guide device is situated to the side of and at least mainly above the axis of rotation of the deflection roller.

35 Claims, 5 Drawing Sheets

TRANSVERSE CONVEYOR ARRANGEMENT AT THE OUTLET OF A CARD

FIELD OF THE INVENTION

The invention relates to a transverse conveyor arrangement at the outlet of a card, in which the fiber web leaving a nip formed between at least two rotatable rolls is deposited on the top run of a transverse conveyor. The conveyor is situated at least substantially under the rolls and moves in the axial direction of the rolls between deflection rollers disposed near the axial ends of the rolls. The transverse conveyor guides the fiber web to one axial end of the rolls, where it is guided downward by a guide device rotating around one or more axes disposed transversely to the roll axes and to the transverse conveyor.

BACKGROUND

In a known transverse conveyor arrangement, the guide device is a roller disposed next to the associated deflection roller, so that a perpendicular line connecting the axes of rotation of the roller and the deflection roller extends horizontally. The cylindrical surfaces of the rotatable rolls forming the nip also extend in the horizontal direction beyond the roller, up to a bottleneck constriction formed for drive purposes.

Although known transverse conveyor arrangements have given good results in practice, the desire for continually higher card outputs is leading towards higher take-off speeds of the card web. There are technological limits to this process, since the card web is a relatively weak structure and tends to overshoot and form loops near the transverse conveyor outlet.

SUMMARY OF THE INVENTION

According to the invention, the rolls disposed above the transverse conveyor have step-like constrictions at their ends associated with the guide device and in front of the position of deflection of the transverse conveyor. The guide device is partially received in the constrictions, and a nip or a nip zone is formed between the guide device and the adjacent deflecting roller of the transverse conveyor. Furthermore, the guide device is situated to the one side of and at least mainly above the axis of rotation of the deflecting roller.

Preferred arrangements in accordance with the invention can in use serve to increase the strength of the card web and simultaneously reduce the tendency to form loops, so that the web take-off speeds can be increased.

Through the incorporation of a part of the guide device in the step-like constrictions in the card outlet rolls, the card web on the conveyor is prevented from overshooting the deflecting roller associated with the guide device or from forming a loop, thus counteracting any loosening of the card web through overshooting, which would also reduce the strength of the web.

Also, since the nip or nip zone is disposed in the diversion-roller zone between 12 o'clock and 3 o'clock positions (the 12 o'clock position corresponding to a 0° position at which the conveyor begins to travel around the deflecting roller and the 3 o'clock position corresponding to a point along the conveyor displaced 90° from the 12 o'clock position), the guide device is better able to counteract the centrifugal forces which occur on conveyor deflection and which can also reduce the strength of the sliver. The arrangement also enables a reduction to be made in the distance between the transverse conveyor and the guide device at the nip or the nip zone, and considerable pre-compression occurs during reversal. The pre-compression also increases the strength of the sliver and facilitates its subsequent travel through a collecting cone. This also reduces the danger of fibers splitting off the sliver on the cone and clogging it, and enables the draw-off speed of the sliver to be increased beyond the previous limits.

The guide device itself may have various forms. It may, for example, be in the form of a single deflection roller. This roller is then preferably disposed in the angular range of 20° to 80° or more preferably 30° to 60° or most preferably at an angle of 45° from the 12 o'clock position. This construction is simple to realize but nevertheless very effective.

Alternatively, the guide device can comprise several rollers, each of which is rotatable around its own axis. The rollers can be disposed in an arcurate path which conforms to the arcuate shape of the transverse conveyor as it travels around the deflecting roller, that is, the axes of the rollers are spaced radially outwardly of the outer surface of the deflecting roller at the outlet of the conveyor. The distances at the nips between the individual rollers and the transverse conveyor can be made increasingly smaller in the direction of motion of the transverse conveyor, so that the web is increasingly compressed progressively by the rollers according to the invention. More particularly, when several rollers are used for the guide device, the rollers may be driven at different speeds. For instance, the first roller to contact the web can be driven at the slowest speed and the rollers located downstream thereof can be driven at progressively faster speeds. This provides a surface speed of the rollers which increases in the direction of motion of the transverse conveyor, so that the web is somewhat stretched as well as being pre-compressed and there is less risk of the web forming coils between the individual rollers.

It is also possible to realize the guide device of the invention by a recirculating (endless) belt or band and in this case also the nip zone can be extended and the web can be progressively pre-compressed.

In general, the surface speed of the guide device should be at least as great as, and preferably greater than, the speed of the transverse conveyor.

Preferred dimensions of the width of the nip are such that the narrowest part of the nip zone has a width of about 3 to 8 mm, preferably 4 to 6 mm and most particularly about 5 mm.

In a particularly preferred embodiment of the invention, the guide device is formed with peripheral grooves. This construction, which can be applied to all the previously mentioned embodiments of the guide device, e.g., when in the form of a roller with peripheral grooves or a rotating belt with peripheral grooves, enables the air enclosed in the web to be rapidly removed after being squeezed out through the precompression process. Since the air can escape easily, there is an increase in the strength of the collected card web and the resulting sliver. It is also possible to reduce the distance between the guide device and the transverse conveyor in the region of the narrowest nip, so that the pre-compression of the card web and therefore the strength of the sliver can be yet further increased according to the invention.

Variations can also be made in the surface structure of the guide device for discharging air in the desired manner. For example, the guide device can be constructed with circumferentially extending grooves, radially extending holes or axially extending openings. Also, the expense of driving the guide device can be reduced to a minimum by using a single drive source to rotate the deflection roller and the guide device.

BRIEF DESCRIPTION OF THE DRAWINGS

The invention will now be explained in detail with reference to embodiments shown in the drawings, in which.

DETAILED DESCRIPTION OF PREFERRED EMBODIMENTS

Figure 1:
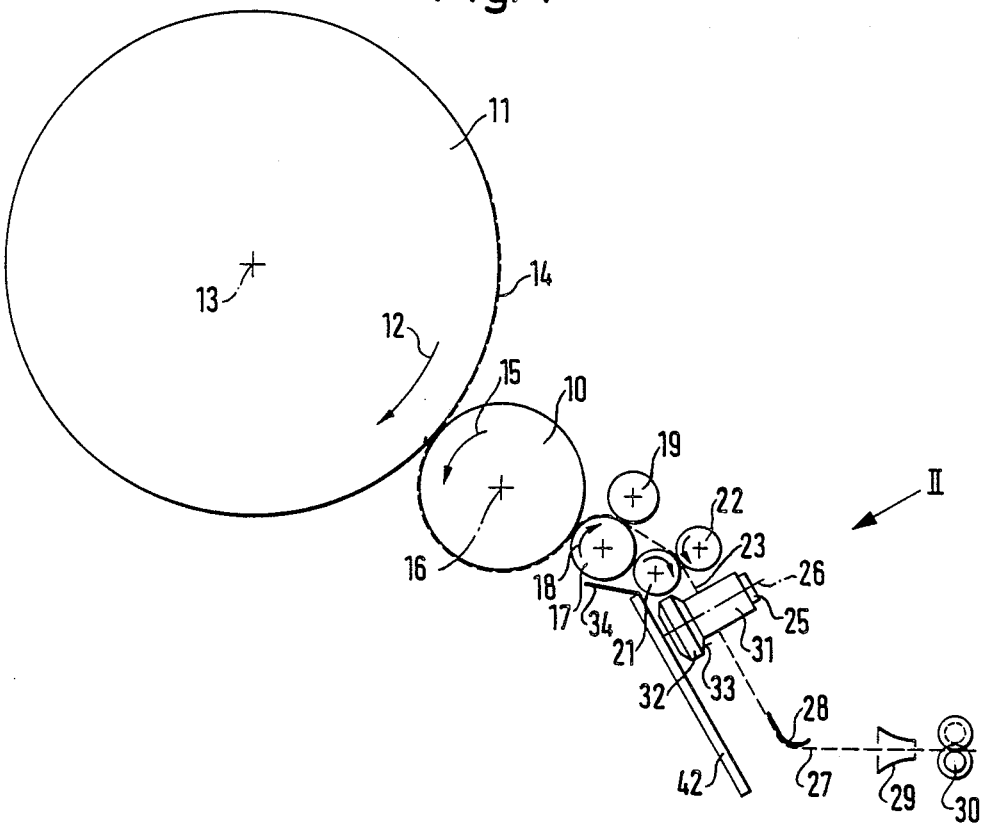
FIG. 1 is a schematic end view of a card arrangement comprising a transverse conveyor band having a shoulder.

FIG. 1 shows the main cylinder 11 of a card which during operation rotates in the direction of arrow 12 around an axis of rotation 13. The main cylinder carries point clothing (not shown) in known manner. Carded fibres 14 are carried on the points and form a very fine combed web. A conventional doffer 10 disposed to the right of the main cylinder rotates in the direction of arrow 15 around its axis of rotation 16. The doffer also has a point clothing in known manner (not shown). The points receive the fibre web delivered by the main cylinder 11 and convey it to a web delivery roll 17, which, e.g., can be grooved and rotates in the direction of arrow 18. A guide roll 19 is disposed opposite the web-delivery roll 17 and rotates in the opposite direction. Rolls 17 and 19 convey the fibre web to a nip between two card outlet rolls 21, 22, with roll 21 rotating in the same direction as roll 17 and roll 22 rotating in the same direction as roll 19. Rolls 21, 22 are highly polished and have two or three grooves, the surfaces of which are helical and have a pitch such that each groove makes about two full turns along the length of rolls 21 and 22.

The doffer 10, the delivery roll 17, the guide roll 19 and the card outlet rolls 21, 22 all extend over the entire width of the main cylinder 11. The fibre web 23 coming out of the nip between rolls 21, 22 is deposited on the top run 24 (FIG. 2) of a transverse conveyor band 31 moving in the axial direction of the card outlet rolls, 21, 22, i.e., at right angles to and into the plane of FIG. 1. The transverse conveyor band 31 is guided over two rollers 25 each disposed adjacent an axial end of the rolls and rotating around a respective axis 26. For simplicity, FIG. 1 shows only one roller 25 and its axis 26.

Figure 8:
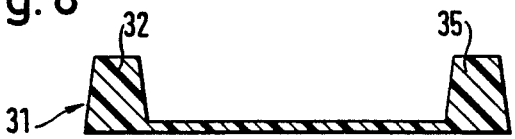
FIG. 8 is a cross-section through a transverse conveyor having two shoulders.

The top run 24 therefore moves in a horizontal direction, but is inclined to the horizontal plane in the transverse direction. In this manner, the fibre web coming out of the nip between the card outlet rolls 21, 22 and having a total width of about 1.25 m is laterally compressed and conveyed in the form of a so-called card web around the reversing roller at the end of the transverse conveyor band 31, so producing a sliver 27 which runs under a curved guide plate 28 and into a measuring hopper 29. After being compressed by the hopper, the sliver runs through known stepped rolls 30, which can be used, e.g., to control the card. As one can see from FIG. 1, the transverse conveyor 31 has a shoulder 32 whose inner side 3 is at an obtuse angle to the outer surface of the transverse conveyor and is used for guiding the fibre web. A cover plate 34 is disposed behind shoulder 32. The transverse conveyor band 31 can also have a second shoulder 35 as shown in FIG. 8.

Figure 2:
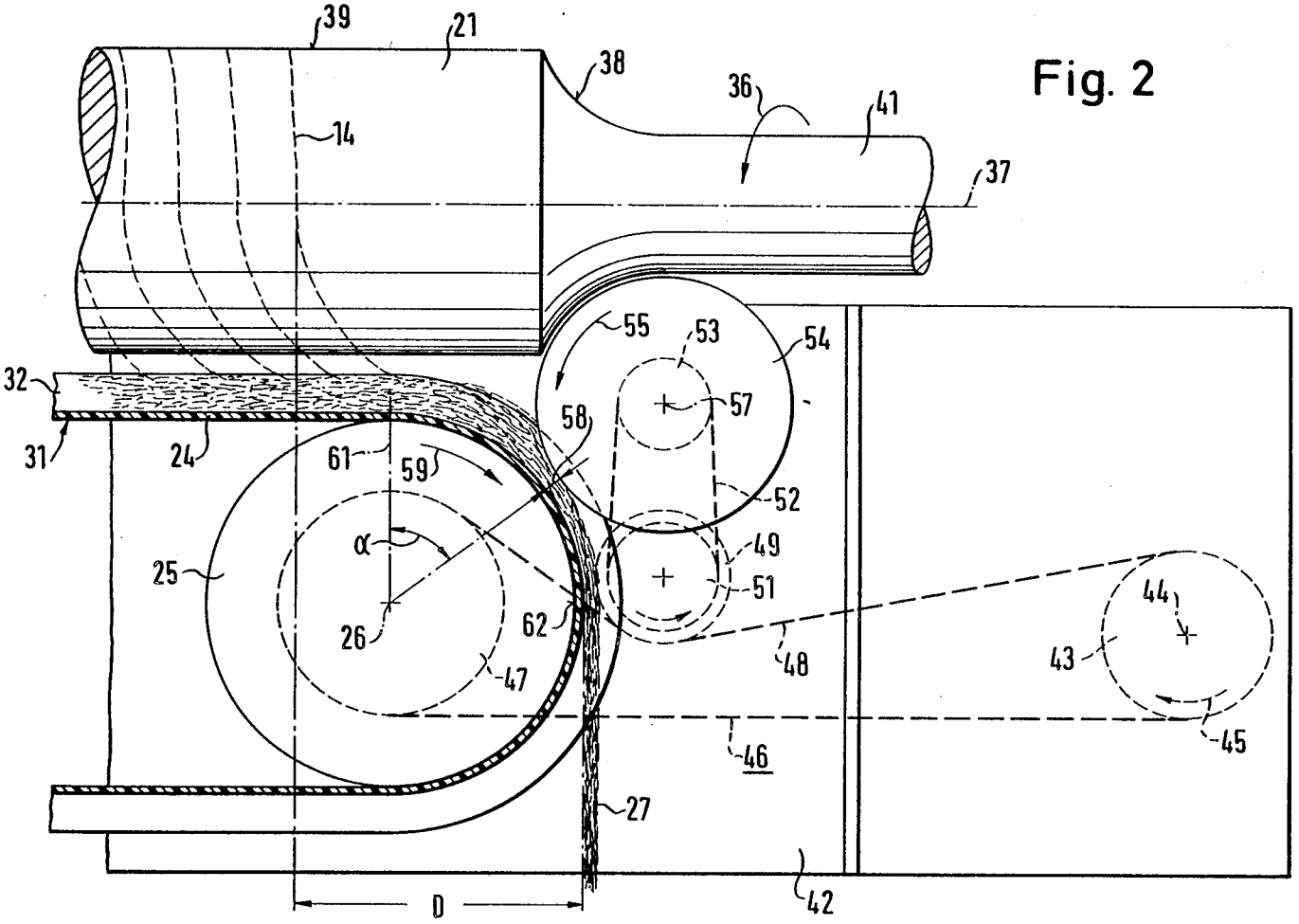
FIG. 2 is an enlarged representation of the deflection zone of the transverse conveyor band in FIG. 1, in the direction of arrow II in FIG. 1.

The present invention particularly relates to the guidance of the fibre web around the reversing roller 25, before it runs in the form of a sliver around the guide plate 28. For simplicity, this special guide is not shown in FIG. 1, but it can be seen on a larger scale in a first embodiment in FIG. 2. The right end of the rear card outlet roll 21 is shown at the top of FIG. 2. The other card outlet roll 22 is disposed in front of roll 21, but is not shown in FIG. 2. The two rolls are identical in shape but driven in different directions as already explained. The card outlet roll 21 in FIG. 2 rotates in the direction of arrow 36 around axis of rotation 37. As clearly shown in FIG. 2, the right end of roll 21 (exactly like the right end of roll 22) has a step-like constriction 38, which in this example is an arc of a circle, so that the cylindrical surface 39 of roll 21 merges via a bottleneck constriction into a cylindrical drive shaft 41, the diameter of which is about one-third of the diameter of the cylindrical surface 39. The drive shaft 41 continues to the right through a bearing on the card frame and is then coupled to a drive source. For simplicity, the drawing shows neither the bearing nor the drive source. A solid plate 42 belonging to the card frame is disposed under the card outlet roll 21 and behind the transverse conveyor 31. Plate 42 bears the shaft for the reversing roller 25 and supports the drive therefor. Only the drive wheel 43 disposed behind plate 42 is shown. Drive wheel 43 has an axis or rotation 44 and is driven in rotation in the direction of arrow 45 by a suitable drive source. The rotation is transmitted to the reversing roller 25 by a rotating toothed chain 46 and a second toothed wheel 47. Since the two toothed wheels 43, 47 and the toothed chain 46 are disposed behind plate 42, they are shown only by broken lines in FIG. 2.

The top run 48 of chain 46 also travels underneath another toothed wheel 49, which is likewise mounted for rotation on and behind plate 42. Wheel 49 also carries a toothed wheel 51 which is concentric therewith and, via another toothed chain 52 and another toothed wheel 53, drives a guide device in the form of a roller 54 in rotation about axis 57 in the direction of arrow 55. The guide roller is disposed to the side of and at least mainly above the axis of rotation 26 of the deflection roller 25. Wheel 53 and chain 52 are likewise disposed behind plate 42 and therefore also shown by chain lines. Wheel 53 is connected to the guide roller 54 via a shaft which is rotatably mounted in plate 42. The guide roller 54 extends over the entire width of the transverse conveyor 31, i.e., between the two shoulders in FIG. 8, and ensures that the fibre web running over the card outlet roller 21 and conveyed to the right by conveyor 31 is pressed against the surface of conveyor 31 at the place where it is reversed around shaft 26, so that the resulting fibre web is compressed to some extent.

According to the invention the axis of rotation 57 of the guide roller is disposed so that the roller surface is partly received in the discontinuous constriction 38 of card outlet roll 21 and partly in the corresponding constriction in card outlet roll 22. As a result, the nip 58 between the surface of guide roller 54 and deflection (reversing) roller 25 or the transverse conveyor 31 reversed around roller 25 is disposed at an angle $\alpha$ of about 45° measured in the clockwise direction, i.e., in the direction of rotation 59 or roller 25 starting from the 12 o'clock position 61. The compressive action of the guide roller on the fibre web extends on both sides of nip 58, e.g., over an angular range of 30° to 60°. As the drawing also shows, the extreme right limit of fibre web 14 is situated by a considerable amount D (D is between 4 and 80 cm) to the left of the place of reversal 62 of the transverse conveyor. As also shown, the nip 58 lies to the left of the place of reversal 62, so that no appreciable bulging occurs in front of the guide roller 54.

Figure 5:
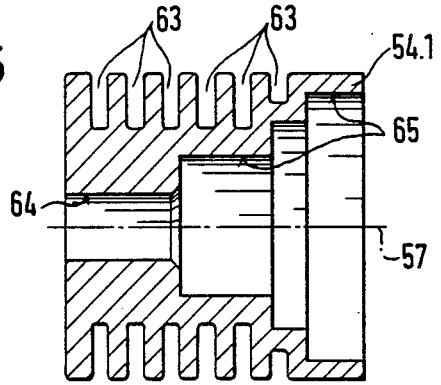
FIG. 5 shows another embodiment of a guide roller for the device in FIG. 2.

Roller 54 can have a continuous cylindrical surface, but is preferably a grooved roller 54.1 as shown in FIG. 5. In other words, the guide roller 54.1 is formed with a number of circular peripheral grooves 63 which enables and helps air to escape from the fibre mat pre-compressed by the roller, thus increasing the strength of the sliver formed after nip 58. The guide roller 54.1 is driven via a driven shaft, which is permanently clamped in a cylinder zone 64 or is positively connected to the guide roller 54.1 by a tongue and groove connection. The cylindrical recesses 65 on the right side of guide roller 54.1 in FIG. 5 are for receiving its bearing.

Figure 6:
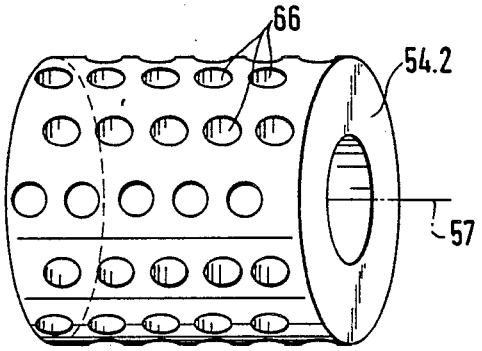
FIG. 6 is a diagram of a guide roller constructed as a sieve drum.
Figure 7:
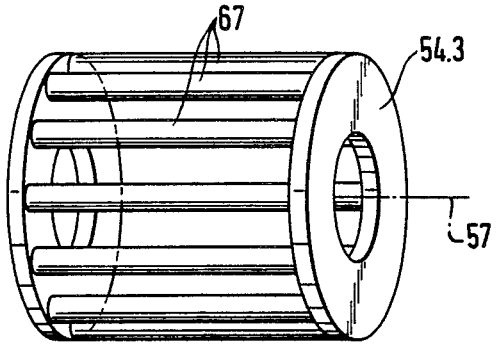
FIG. 7 is a diagram of a guide roller constructed as a rotating cage.

FIG. 6 shows an alternative construction of the guide roller as a sieve drum 54.2. Air which is squeezed out when the fibre web is pre-compressed can escape through holes 66 into the interior of the drum. Alternatively, a perforate sieve ring can be shrunk on a guide roll 54.1 constructed as per FIG. 5. FIG. 7 shows another variant of the guide roll 54.3, i.e., constructed as a cage roller. In this case, air expelled by the precompression can escape through the gaps between the individual bars 67 of the cage roller.

Figure 3:
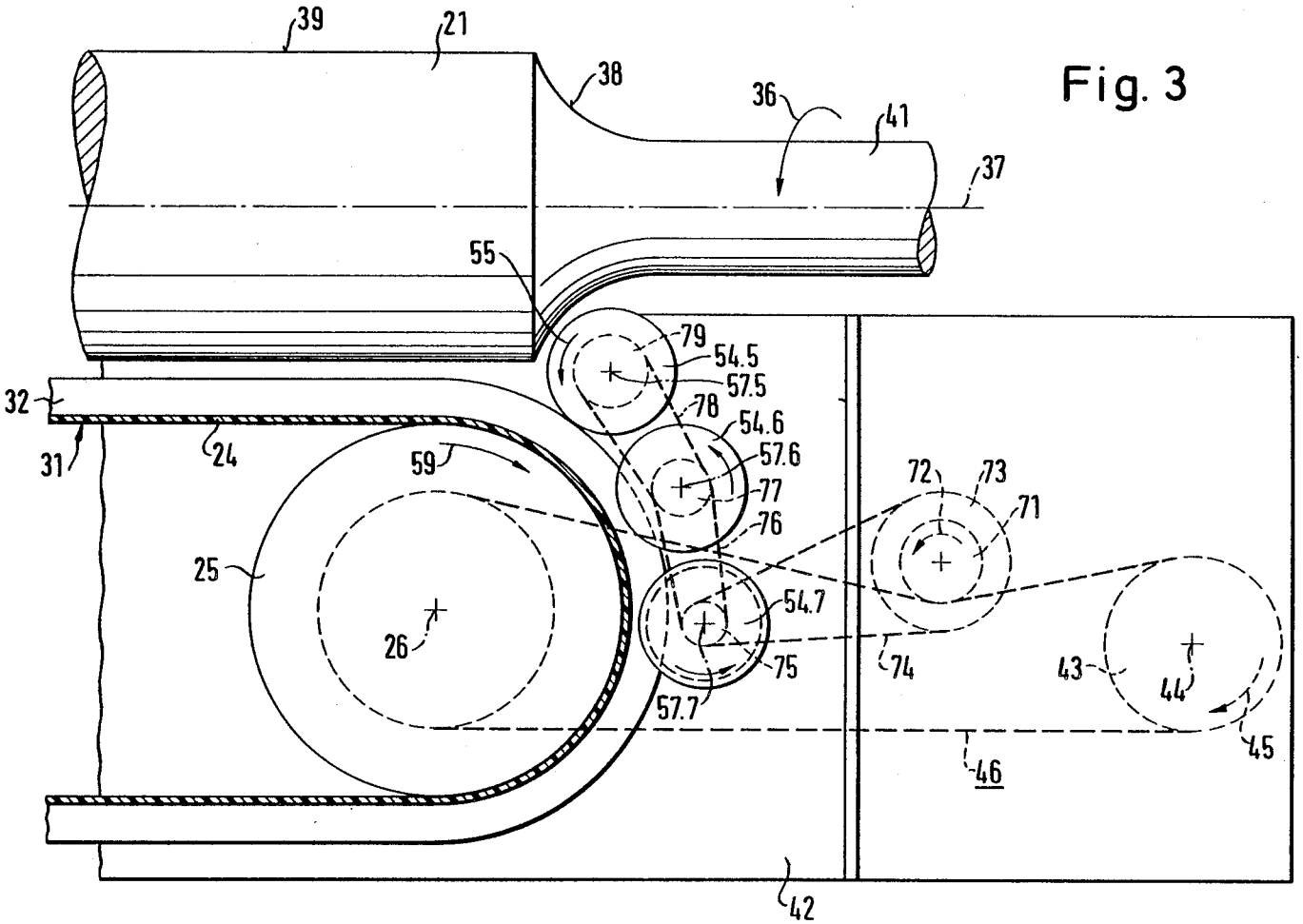
FIG. 3 is a diagram corresponding to FIG. 2 but showing a variant of the guide device in FIG. 2.

FIG. 3 largely corresponds to FIG. 2, so that like reference numbers have been used for like parts. The main difference between the embodiments in FIG. 3 and FIG. 2 is that the guide device in FIG. 3 comprises three individual rollers 54.5, 54.6 and 54.7 instead of a single guide roller. The three rollers in this example have the same diameter but are driven at different surface speeds, so that the guide roller 54.7 rotates more quickly than roller 54.6, which in turn rotates more quickly than roller 54.5. The surface speed of roller 54.5 is substantially the same as the surface speed of the transverse conveyor 31. In the present case the drive arrangement is such that the toothed chain 46 drives a toothed wheel 71 counterclockwise, as marked by arrow 72. Wheel 71 bears a second toothed wheel 73 having a somewhat larger diameter and, via a toothed chain 74, driving a toothed wheel 75 non-rotatably secured to the guide roller 54.7. Wheel 75 is a double wheel and, via another toothed chain 76, drives a toothed wheel 77, which is non-rotatably connected to the second guide roller 54.6. Wheel 77 is also a double wheel and drives another chain 78, thus rotating yet another toothed wheel 79 which is non-rotatably coupled to the first guide roller 54.5. All the toothed chains and wheels are mounted behind the card-frame plate 42, and are therefore shown as broken lines. The shafts and bearings of the toothed wheels are borne by plate 42. The actual shafts extend through plate 42, so that the guide rollers 54.5, 54.6, 54.7 can be disposed on the front of the plate. Instead of showing the actual shafts, FIG. 3, like FIGS. 2 and 4, shows only the imaginary axes of rotation, marked by crosses.

The three imaginary axes of rotation 57.5, 57.6 and 57.7 of the three guide rollers 54.5, 54.6 and 54.7 are disposed so that the nip distance between the guide roller 54.5 and the surface of transverse conveyor 31 on the reversing roller 25 is greater than the corresponding distance in the case of guide roller 54.6, and the distance in the case of guide roller 54.6 is in turn greater than the nip distance in the case of guide roller 54.7. As a result, the fibre web is increasingly pre-compressed, and the air expelled as a result can escape without difficulty between the individual guide rollers. This embodiment is not restricted to three guide rollers; e.g., there can be two or four or even more. The guide rollers can also vary in diameter and they can also have grooved or perforated surfaces or be constructed as rotating cages.

Figure 4:
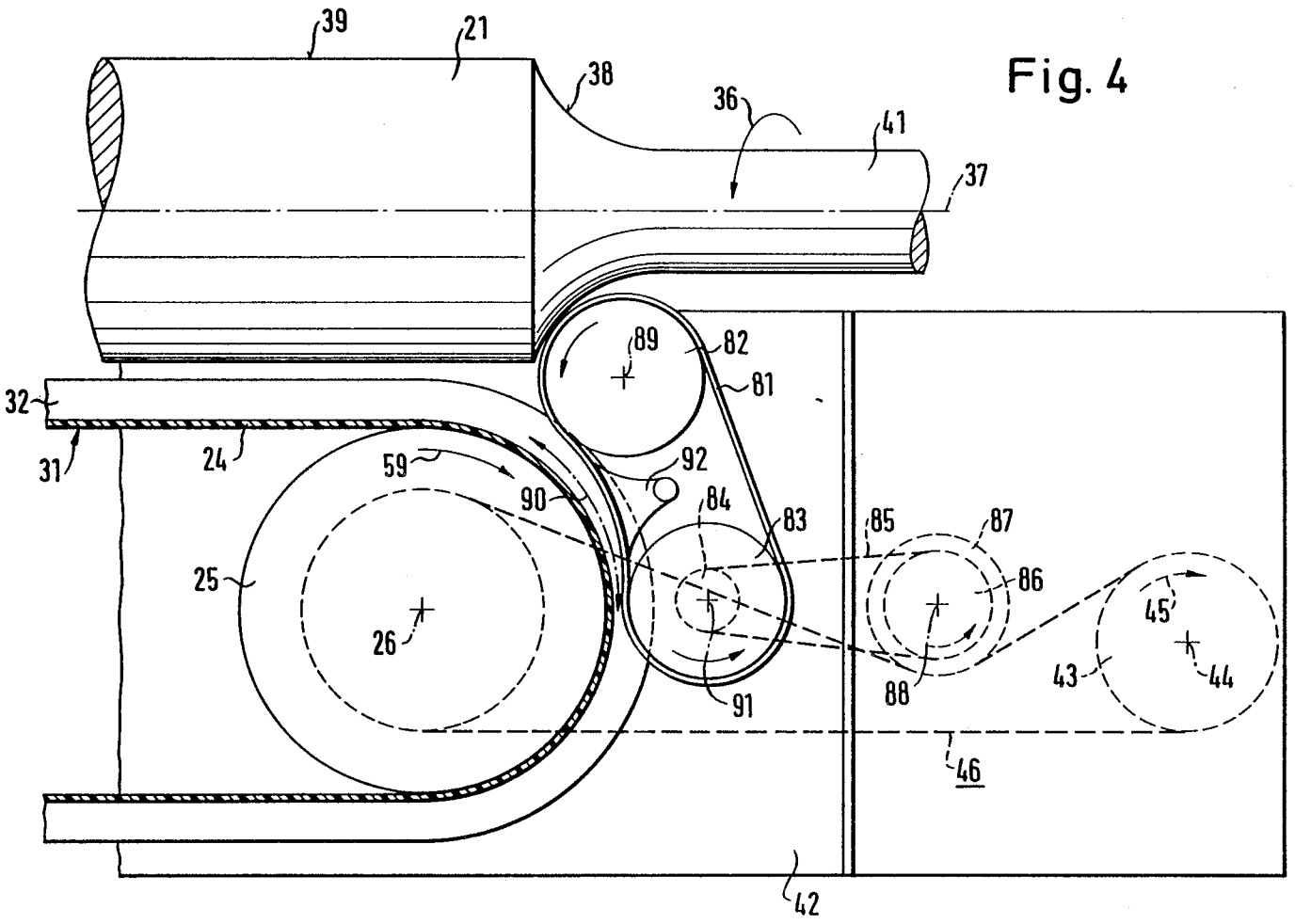
FIG. 4 is a drawing corresponding to FIG. 2 or 3 but showing another variant of the guide device.

FIG. 4 shows another possible guide device. As before, like parts have the same reference numbers as in the previous embodiments. In the embodiment in FIG. 4, the guide device does not comprise rollers but rather, a rotating belt 81 which runs around two reversing rollers 82 and 83. The upper roller 82 is rotatably secured to plate 42 around a stationary stub axle. The lower roller 83 is rotatably mounted and driven by a toothed wheel 84. Wheel 84 is driven via a toothed chain 85 by another toothed wheel 86, which is non-rotatably coupled to a somewhat larger toothed wheel 87, which is driven about axis 88 by the toothed chain 46 in the direction shown by an arrow. As before, all the toothed wheels are disposed behind plate 42, and therefore represented by broken lines. Since there is an appreciable distance between the imaginary axes of rotation 89, 91 of reversing rollers 82 and 83, a static curved guide 92 is disposed between the reversing rollers 82, 83. Guide 92 ensures that the run of the rotating belt 81 facing the reversing roller 25 is guided so that the fibre web becomes increasingly compressed. As FIG. 4 shows, in this embodiment the precompression is brought about over an angular range 90 of 20° to 80°, the range having the same dimensions as the angle $\alpha$ in the embodiment in FIG. 2. Alternatively, the angular range can be disposed so that it extends beyond the 90° position. This is also possible in the embodiment in FIG. 3.

To enable air to escape after being squeezed out by the pre-compression of the fibre web, it is advantageous to form peripheral grooves on the surface of belt 81.

In all the embodiments, adjustable clamping rollers can be used for holding the toothed chains. Of course, any other kind of drive can also be considered.

While the invention has been described with reference to the foregoing embodiments, changes and modifications may be made thereto which fall within the scope of the appended claims.

What is claimed is:

1. A transverse conveyor arrangement at the outlet of a card, in which a fibre web leaving a gap formed between at least two rotatable rolls is deposited on a top run of an endless transverse conveyor situated at least substantially under the rolls and moving in the axial direction of the rolls between deflecting around which the transverse conveyor is guides, one of the deflecting rollers being disposed near one axial end of the rolls and the other one of the deflecting rollers being disposed near an opposite axial end of the rollers, the transverse conveyor guiding the fibre web to one axial end of the rolls, where the fibre web is guided downwards by guide means moving around at least one axis disposed transversely to the roll axes and to the transverse conveyor direction of movement, the rolls being disposed above the transverse conveyor and each having a step-like constriction at their ends associated with the guide means and outwardly of a position of deflection of the transverse conveyor, the guide means being partially received in the constriction, at least one nip being formed between the guide means and an adjacent deflection roller of the transverse conveyor, the guide means being situated to the side of and at least mainly above an axis of rotation of the deflection roller.

2. A transverse conveyor arrangement according to claim 1, wherein the guide means comprises a roller.

3. A transverse conveyor arrangement according to claim 2, wherein a narrowest place in the nip formed between the roller and the transverse conveyor running on the surface of the deflection roller is disposed at an angular position in the range between 20° and 80° with respect to a 0° position at which the conveyor begins to travel around the deflection roller.

4. A transverse conveyor arrangement according to claim 1, wherein the guide means comprises at least two rollers, each of which is rotatably mounted about a separate axis of rotation and cooperating with the surface of the transverse conveyor traveling around the deflection roller to form the at least one nip, the nips preferably being disposed over an angular range of between 20° and 80° with respect to a 0° position at which the conveyor begins to travel around the deflection roller.

5. A transverse conveyor arrangement according to claim 4, wherein distances at the nips between the individual rollers and the transverse conveyor are increasingly smaller in a direction of rotation of the transverse conveyor.

6. A transverse conveyor arrangement according to claim 4, including means for driving the rollers at a surface speed which increases with respect to each other in a direction of motion of the transverse conveyor.

7. A transverse conveyor arrangement according to claim 1, wherein the guide means comprises a rotating belt which cooperates with the surface of the transverse conveyor traveling around the deflection roller to form an extended nip zone comprising the at least one nip which extends over an angular range of about 30° to 60° with respect to a 0° position at which the conveyor begins to travel around the deflection roller.

8. A transverse conveyor arrangement according to claim 1, wherein the guide means has a surface speed which is at least as great as a surface speed of the rotating transverse conveyor.

9. A transverse conveyor arrangement according to claim 1, wherein the nip has a width between the conveyor and the guide means in the range from 3 to 8 mm.

10. A transverse conveyor arrangement according to claim 1, wherein surface of the guide means includes grooves extending in the direction of rotation thereof.

11. A transverse conveyor arrangement according to claim 2, wherein the roller includes a number of peripheral grooves disposed side by side.

12. A transverse conveyor arrangement according to claim 2, wherein the roller comprises a sieve drum.

13. A transverse conveyor arrangement according to claim 2, wherein the roller comprises a rotor-blade roller.

14. A transverse conveyor arrangement according to claim 1, wherein the deflection roller disposed near the guide device is driven by drive means selected from the group consisting of a belt, toothed-chain and chain drive and the drive means also drives the guide means in rotation.

15. A transverse conveyor arrangement according to claim 1, wherein the transverse conveyor at least on its longitudinal side facing the main cylinder includes a shoulder disposed on the outer surface of the transverse conveyor guiding the fibre web, and the transverse conveyor includes on its longitudinal side remote from the main cylinder a second shoulder which is disposed on its outer surface conveying the fibre web.

16. A transverse conveyor arrangement according to claim 3, wherein the angular position is in the range of 30° to 60°.

17. A transverse conveyor arrangement according to claim 3, wherein the angular position is about 45°.

18. A transverse conveyor arrangement according to claim 9, wherein the width is about 4 to 6 mm.

19. A transverse conveyor arrangement according to claim 9, wherein the width is about 5 mm.

20. A guide means for compressing a fibre web at an outlet of a transverse conveyor arrangement at an outlet of a card wherein the fibre web is deposited on a top run of a transverse conveyor situated at least substantially under at least two rolls and the transverse conveyor guides the fibre web to one axial end of the rolls, the guide means comprising at least one guide member for compressing the fibre web in at least one compression zone when the guide means is assembled at the outlet of the transverse conveyor arrangement, the guide member being rotatable around at least one axis extending transversely to axes of the rolls when the guide means is assembled at the outlet of the transverse conveyor arrangement, the compression zone being located in an angular range along a deflection roller intermediate a 0° position at which the fibre web begins to travel around the deflection roller and a second position located 90° therefrom, the guide member being sized to fit within step-like constrictions in the at least two rolls at ends thereof adjacent the outlet of the transverse conveyor.

21. A guide means according to claim 20, wherein the guide member comprises a roller.

22. A guide means for compressing a fibre web at an outlet of a transverse conveyor arrangement at an outlet of a card wherein the fibre web is deposited on a top run of a transverse conveyor situated at least substantially under at least two rolls and the transverse conveyor guides the fibre web to one axial end of the rolls, the guide means comprising at least one guide member for compressing the fibre web in at least one compression zone when the guide means is assembled at the outlet of the transverse conveyor arrangement, the guide member being rotatable around at least one axis extending transversely to axes of the rolls when the guide means is assembled at the outlet of the transverse conveyor arrangement, the compression zone being located in an angular range along a deflection roller intermediate a 0° position at which the fibre web begins to travel around the deflection roller and a second position located 90° therefrom, the at least one guide member comprising at least two rollers, each of which is rotatably mounted about a separate axis of rotation when the guide means is assembled at the outlet of the transverse conveyor arrangement.

23. A guide means according to claim 22, wherein a gap between each respective one of the rollers and the transverse conveyor is increasingly smaller in a direction of rotation of the transverse conveyor.

24. A guide means for compressing a fibre web at an outlet of a transverse conveyor arrangement at an outlet of a card wherein the fibre web is deposited on a top run of a transverse conveyor situated at least substantially under at least two rolls and the transverse conveyor guides the fibre web to one axial end of the rolls, the guide means comprising at least one guide member for compressing the fibre web in at least one compression zone when the guide means is assembled at the outlet of the transverse conveyor arrangement, the guide member being rotatable around at least one axis extending transversely to axes of the rolls when the guide means is assembled at the outlet of the transverse conveyor arrangement, the compression zone being located in an angular range along a deflection roller intermediate a 0° position at which the fibre web begins to travel around the deflection roller and a second position located 90° therefrom, the guide member comprising a rotating belt which cooperates with an outer surface of the transverse conveyor to form an extended compression zone when the guide means is assembled at the outlet of the transverse conveyor arrangement.

25. A guide means for compressing a fibre web at an outlet of a transverse conveyor arrangement at an outlet of a card wherein the fibre web is deposited on a top run of a transverse conveyor situated at least substantially under at least two rolls and the transverse conveyor guides the fibre web to one axial end of the rolls, the guide means comprising at least one guide member for compressing the fibre web in at least one compression zone when the guide means is assembled at the outlet of the transverse conveyor arrangement, the guide member being rotatable around at least one axis extending transversely to axes of the rolls when the guide means is assembled at the outlet of the transverse conveyor arrangement, the compression zone being located in an angular range along a deflection roller intermediate a 0° position at which the fibre web begins to travel around the deflection roller and a second position located 90° therefrom, an outer surface of the guide member including grooves extending in the direction of rotation thereof.

26. A guide means for compressing a fibre web at an outlet of a transverse conveyor arrangement at an outlet of a card wherein the fibre web is deposited on a top run of a transverse conveyor situated at least substantially under at least two rolls and the transverse conveyor guides the fibre web to one axial end of the rolls, the guide means comprising at least one guide member for compressing the fibre web in at least one compression zone when the guide means is assembled at the outlet of the transverse conveyor arrangement, the guide member being rotatable around at least one axis extending transversely to axes of the rolls when the guide means is assembled at the outlet of the transverse conveyor arrangement, the compression zone being located in an angular range along a deflection roller intermediate a 0° position at which the fibre web begins to travel around the deflection roller and a second position located 90° therefrom, the guide member comprising a roller and the roller including a number of peripheral grooves on an outer surface thereof disposed side by side.

27. A guide means for compressing a fibre web at an outlet of a transverse conveyor arrangement at an outlet of a card wherein the fibre web is deposited on a top run of a transverse conveyor situated at least substantially under at least two rolls and the transverse conveyor guides the fibre web to one axial end of the rolls, the guide means comprising at least one guide member for compressing the fibre web in at least one compression zone when the guide means is assembled at the outlet of the transverse conveyor arrangement, the guide member being rotatable around at least one axis extending transversely to axes of the rolls when the guide means is assembled at the outlet of the transverse conveyor arrangement, the compression zone being located in an angular range along a deflection roller intermediate a 0° position at which the fibre web begins to travel around the deflection roller and a second position located 90° therefrom, the guide member comprising a roller and the roller comprising a sieve drum.

28. A guide means for compressing a fibre web at an outlet of a transverse conveyor arrangement at an outlet of a card wherein the fibre web is deposited on a top run of a transverse conveyor situated at least substantially under at least two rolls and the transverse conveyor guides the fibre web to one axial end of the rolls, the guide means comprising at least one guide member for compressing the fibre web in at least one compression zone when the guide means is assembled at the outlet of the transverse conveyor arrangement, the guide member being rotatable around at least one axis extending transversely to axes of the rolls when the guide means is assembled at the outlet of the transverse conveyor arrangement, the compression zone being located in an angular range along a deflection roller intermediate a 0° position at which the fibre web begins to travel around the deflection roller and a second position located 90° therefrom, the guide member comprising a roller and the roller comprising a rotor-blade roller.

29. A guide means according to claim 24, including a belt guide pressing the rotating belt against the fibre web in the compression zone when the guide means is assembled at the outlet of the transverse conveyor arrangement.

30. A transverse conveyor arrangement at an outlet of a card, in which a fibre web leaving a gap formed between at least two rotatable rolls is deposited on a run of an endless transverse conveyor situated adjacent the rolls and moving in the axial direction of the rolls between deflecting rollers disposed near the axial ends of the rolls, a surface of the transverse conveyor guiding the fibre web t one axial end of the rolls, where the fibre web is guided by guide means moving around at least one axis disposed transversely to the roll axes and to the transverse conveyor, the rolls being disposed adjacent the transverse conveyor and each having a step-like constriction at their ends associated with the guide means and outwardly of a position of deflection of the transverse conveyor, the guide means being partially received in the constriction, at least one nip being formed between the guide means and an adjacent deflection roller of the transverse conveyor, the guide means being situated to the side of an axis of rotation of the deflection roller.

31. A transverse conveyor arrangement according to claim 30, wherein the guide means comprises a roller.

32. A transverse conveyor arrangement according to claim 31, wherein a narrowest place in the at least one nip formed between the roller and the transverse conveyor running on a surface of one of the deflection rollers is disposed at an angular position in the range between 20° and 80° with respect to a 0° position at which the conveyor begins to travel around the one of the deflection rollers.

33. A transverse conveyor arrangement according to claim 30, wherein the guide means comprises at least two rollers, each of which is rotatably mounted about a separate axis of rotation and cooperating with the surface of the transverse conveyor traveling around one of the deflection rollers to form respective nips, the nips preferably being disposed over an angular range of between 20° and 80° with respect to a 0° position at which the conveyor begins to travel around the deflection roller.

34. A transverse conveyor arrangement according to claim 33, wherein distances at the nips between the individual rollers and the transverse conveyor are increasingly smaller in a direction of rotation of the transverse conveyor.

35. A transverse conveyor arrangement according to claim 30, wherein the guide means comprises a rotating belt which cooperates with the surface of the transverse conveyor traveling around the deflection roller to form an extended nip zone comprising the at least one nip which extends over an angular range of about 30° to 60° with respect to a 0° position at which the conveyor begins to travel around the deflection roller.

* * * * *